US005784715A

United States Patent [19]

Buchanan

[11] Patent Number: 5,784,715

[45] Date of Patent: Jul. 28, 1998

[54] LADDER-MATE SHIN PROTECTOR

[76] Inventor: George S. Buchanan, 19499 NE. 10th Ave., Miami, Fla. 33179

[21] Appl. No.: 815,923

[22] Filed: Mar. 13, 1997

[51] Int. Cl.[6] ..... A41D 13/00

[52] U.S. Cl. ..... 2/22; 2/455

[58] Field of Search ..... 2/22–24, 455, 2/456

[56] References Cited

U.S. PATENT DOCUMENTS

| | | | |
|---|---|---|---|
| 1,991,721 | 2/1935 | Becket et al. | 2/22 |
| 2,266,886 | 12/1941 | McCoy | 2/22 |
| 2,785,407 | 3/1957 | Reeder | 2/22 |
| 3,044,075 | 7/1962 | Rawlings | 2/22 |
| 3,259,910 | 7/1966 | Daignault | 2/24 |
| 3,465,365 | 9/1969 | Jones et al. | 2/24 |
| 3,621,489 | 11/1971 | Keller | 2/22 |
| 4,484,360 | 11/1984 | Leighton et al. | 2/22 |
| 4,512,037 | 4/1985 | Vacanti | 2/22 |
| 4,599,747 | 7/1986 | Robinson | 2/24 X |
| 4,926,501 | 5/1990 | Goosen . | |
| 4,999,847 | 3/1991 | Barcelo . | |
| 5,297,294 | 3/1994 | Washick . | |
| 5,301,370 | 4/1994 | Henson | 2/24 |
| 5,507,720 | 4/1996 | Lampropoulos . | |
| 5,625,896 | 5/1997 | LaBarbera et al. | 2/22 |

*Primary Examiner*—Gloria M. Hale
*Attorney, Agent, or Firm*—Patent & Trademark Services; Thomas Zack; Joseph H. McGlynn

[57] ABSTRACT

A shin protector apparatus having three protective joined layers. The first larger layer, which engages the user's skin, is made of a soft sponge material and has side spaced elastic straps to fasten the layer around a user's leg and shin. Extending in the same direction as the first layer is a smaller second vertically disposed layer made of a hard plastic material. The third outer layer, about the same size and configuration as the second layer and made of a semi-hard material. All three layers are bonded or sewn together to form a unitary structure.

6 Claims, 1 Drawing Sheet

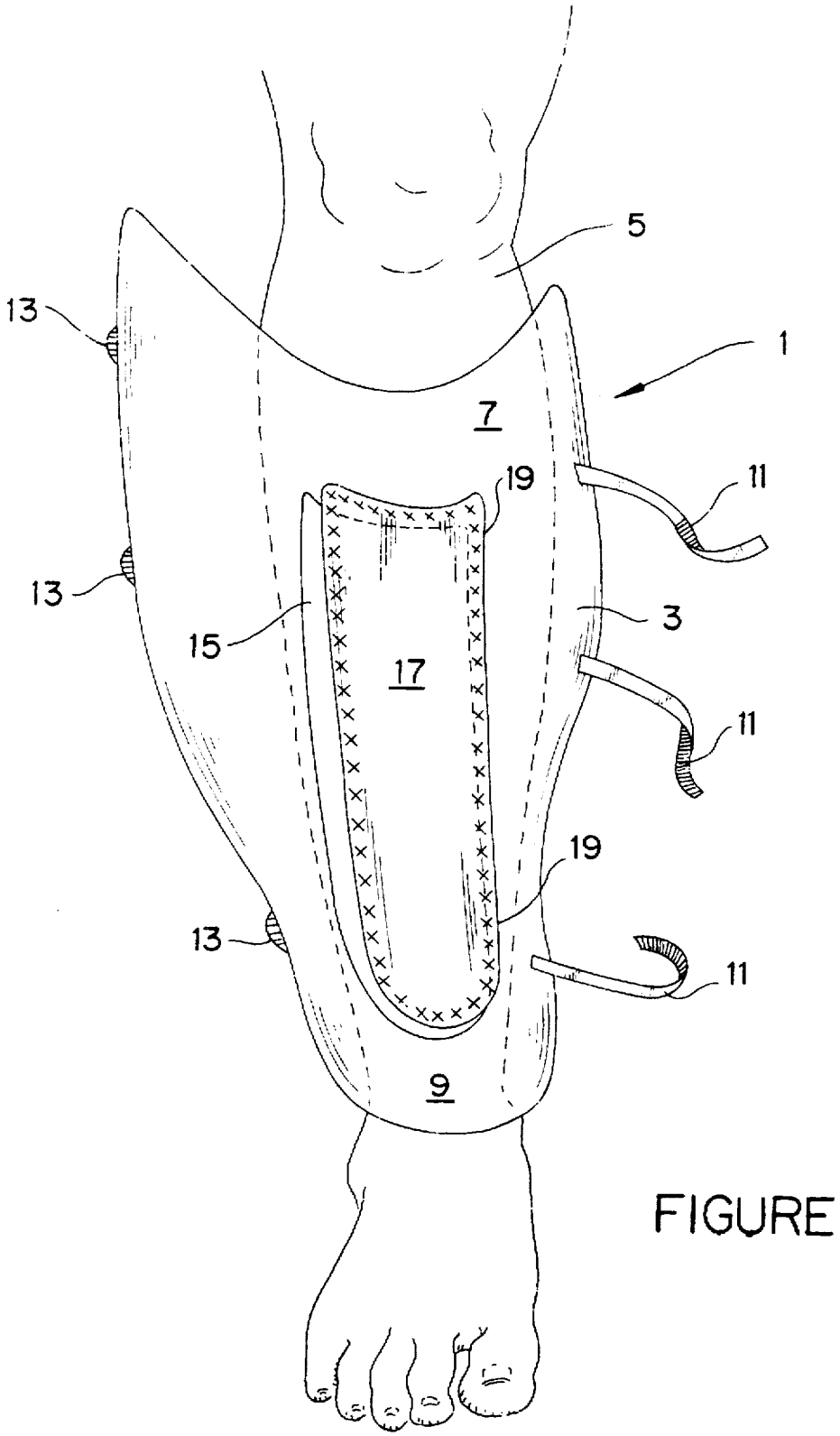
FIGURE

LADDER-MATE SHIN PROTECTOR

BACKGROUND OF THE INVENTION

Persons who frequently ascend and descend ladders are well aware of the dangers associated with this activity. One of the most frequent ones which can result in injury, or even falling from the ladder, is that of shin injuries which occur by striking edges of the ladder such as those on the ladder's steps. The present invention seeks to provide an inexpensive protective wearing apparatus which is worn about a user's shins which will substantially eliminate or reduce injury from this type of impact.

DESCRIPTION OF THE PRIOR ART

Shin protectors and guards are well known. Some are used principally in sporting activities while other find their use primary in activities associated with work. For example, a lower leg guard is disclosed in U.S. Pat. No. 4,926,501 to Goosen having an inner corrugated shock absorbing protective member within an outer relatively soft enclosure over the patient's leg. In the patent to Barcelo (U.S. Pat. No. 4,999,847) a knee and shin guard is described which has a flexible extending tongue member from the knee protector to the interior surface of the shin protector. U.S. Pat. No. 5,297,294 to Washick shows a shin guard and knee shield with the shield being connected to guard by a grooved hinged flexible web. And in U.S. Pat. No. 5,507,720 to Lampropoulos a shin and ankle protector is disclosed whose shin protector has a molded plastic shell with an inner pad. The present invention discloses a shin protector having a large inner soft layer with a middle hard plastic layer attached to inner layer and a semi-hard outer layer all as more further set forth in this specification.

SUMMARY OF THE INVENTION

This invention relates to a shin protector having three protective layers. The first or inner larger layer, which engages the user's skin, is made of a soft material and has elastic straps to fasten the layer to the user. Extending in the same direction as the first layer is a smaller second or middle vertically disposed layer made of a hard plastic material. The third or outer layer is about the same size and configuration as the second layer and made of a semi-hard material. All three layers are bonded to their facing layer or layers to form a unitary structure.

It is the primary object of the present invention to provide for an improved apparatus to protect a user's shin.

Another object is to provide for such a protector having three joined layers to protect and absorb user impacts.

These and other objects and advantages of the present invention will become apparent to readers from a consideration of the ensuing description and the accompanying drawings.

BRIEF DESCRIPTION OF THE DRAWINGS

The FIGURE is a front view of the invention's preferred embodiment.

DESCRIPTION OF THE PREFERRED EMBODIMENT

The FIGURE is a front view of the invention's preferred embodiment 1 and shows its three layered construction in an unfastened state. The inner or first layer 3 is the largest and made of a soft sponge material which extends along a user's 5 shin area from just below the user's knee to just above the ankle. Clearly different sized inner layers would be needed to accommodate different sized individual users. The upper section 7 of layer 3 is wider than this layer's lower section 9 to conform to the typical size variates of a person's lower leg. Three elastic straps 11 are sewn to and spaced along one side of layer 3 and can be fastened around the shin and lower leg by joining with three spaced fasteners 13 sewn or otherwise attached to the opposite front side of layer 3. Hoop and loop (VELCRO™) or other fasteners may be provided on the ends of straps 11 and side fasteners 13 to securely hold the inner layer around the user's leg and shin.

A middle layer 15 having a smaller facing surface area than the first layer and made of a hard rigid plastic material extends vertically along the inner layer and is joined thereto by a strong bonding material. Commercially available glues specifically formulated to bind with the hard plastic material used for layer 15 and the soft sponge material in layer 3 can be used for this purpose. The middle layer is placed on the larger layer 3 such that it will cover and protect the shin of a user for one when the straps 11 are properly fastened around the leg and its shin.

The outer or third layer 17 is slightly larger in facing surface area than the middle layer 15 with the same general configuration and orientation to protect a user's shin. Normally, the outer layer is made from a semi-hard rubber material which is softer than the material in middle layer 15 but firmer than the material making up inner layer 3. This third layer may be bonded to the plastic middle layer and bonded or sewn along its peripheral edges at 19 to the inner layer 3 which edges extends past the periphery of middle layer 15.

When properly bonded or sewn to each other the three layers provide a unitary structure which can protect a user's shins by providing a soft inner shock absorbing layer, a middle hard protective layer and a semi-hard outer rubber layer to provide both functions while minimizing the possibility that a user will slip if the apparatus strikes against a step or other ladder part.

Normally two such shin protectors would be worn by a user with one on each leg. Clearly, other material with the same characteristics could be used for the three layers in addition to those described as long as the inner layer is soft, the middle layer rigid and the outer layer semi-hard.

In use the user mount the first layer and its straps to one side such as shown in the FIGURE and then pulls the strap ends around the leg and fastens them into fastener 13. This provides a sure but soft grip as the first protective layer engages the user's skin and its material can readily absorb impact. The harder protective second layer, strategically placed to protect and shield the shin insures impacts will be deflected and no damage will occur to the first layer. The outer or third protective layer acts to protect and deflect impacts to the shin with its semi-hard rubber material as well as absorbing some impact. This third layer also provides a slid resistant surface when engaging objects such as ladder steps.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A shine protector apparatus comprising:

A first layer made of a soft material and adapted to engage the skin of a user about the lower leg and shin, said first layer having sides with means along said sides for fastening the first layer around a user's lower leg and shin;

a second layer facing against said first layer and smaller in facing surface area than said first layer and extending in the same vertical direction as a user's shin area when worn, said second layer being made of a material substantially harder and more rigid than said first layer; and a third layer substantially the same shape as the second layer and overlapping and facing against the second layer and extending in the same direction, said third layer being made of a material less rigid than the second layer but harder than the first layer whereby said three layers face each other one on top of the other and are joined together to form a single unitary three layered structure.

2. The invention as claimed in claim 1, wherein said means along the first layer's longitudinal sides for fastening the layer to a user comprises a plurality of spaced straps located along one of its sides which engage a like number of spaced fasteners on the first layer's opposite side.

3. The invention as claimed in claim 2, wherein said first layer is bonded directly to said second layer, said second layer being made of a hard plastic material.

4. The invention as claimed in claim 3, wherein said first layer is made of a soft sponge material whose straps for fastening the layer around the user's lower leg and shin are made of an elastic material.

5. The invention as claimed in claim 4, wherein said third layer is made of a semi-hard rubber material slightly larger in facing surface area than the second layer and sewn thereto by threads extending through the third layer's peripheral edges.

6. The invention as claimed in claim 5, wherein said elastic straps for fastening the first layer to a user have hook and loop end fasteners.

* * * * *